US005626328A

United States Patent [19]

Schneider

[11] Patent Number: 5,626,328

[45] Date of Patent: May 6, 1997

[54] FLAT LIFTING DEVICE

[75] Inventor: Johannes Schneider, Bünde, Germany

[73] Assignee: Dewert Antriebs- und Systemtechnik GmbH & Co. KG, Kirchlengern, Germany

[21] Appl. No.: 346,768

[22] Filed: Nov. 30, 1994

[30] Foreign Application Priority Data

Dec. 6, 1993 [DE] Germany ..... 9318553 U
Oct. 4, 1994 [DE] Germany ..... 9415930 U

[51] Int. Cl.[6] ..... B66F 3/08

[52] U.S. Cl. ..... 254/98

[58] Field of Search ..... 108/106, 144–150; 312/349, 350; 5/611, 616; 384/20, 42; 464/51, 52; 74/89.15; 269/285; 254/98, 103, 89 R, 424, 425, 7 R, 7 B, 7 C; 308/42, 35, 37

[56] References Cited

U.S. PATENT DOCUMENTS

| | | | |
|---|---|---|---|
| 2,368,748 | 2/1945 | Doty | 108/147 |
| 2,683,341 | 7/1954 | Kock | 464/52 |
| 3,022,043 | 2/1962 | Weiss | 254/98 |
| 3,210,846 | 10/1965 | Balkin | 108/147 |
| 3,537,762 | 11/1970 | Lodige | 384/42 |
| 4,206,910 | 6/1980 | Biesemeyer | 269/285 |
| 5,064,318 | 11/1991 | Cirillo | 384/37 |
| 5,131,761 | 7/1992 | Bury | 384/37 |
| 5,268,970 | 12/1993 | Tanaka | 384/25 |
| 5,285,733 | 2/1994 | Waibel | 108/144 |
| 5,365,862 | 11/1994 | Peterson | 108/144 |

*Primary Examiner*—Robert C. Watson
*Attorney, Agent, or Firm*—Henry M. Feiereisen

[57] ABSTRACT

A flat lifting device includes an outer and an inner hollow section rail with closed cross section and with a substantially greater width than a thickness. One of the section rails is acted upon by a drive unit having a linearly moveable drive member for shifting the one section rail relative to the other section rail. Opposing surfaces of the outer and inner section rails are preferably provided with meshing profiles which extend in moving direction of the slideable section rail.

30 Claims, 5 Drawing Sheets

FLAT LIFTING DEVICE

BACKGROUND OF THE INVENTION

The present invention refers to a flat lifting device in particular for use with pieces of furniture such as vertically adjustable tables, hospital beds, slat frame beds, TV chairs or the like.

Hitherto, operating drives have been used which are generally designed for a particular purpose and are not universally applicable.

SUMMARY OF THE INVENTION

It is an object of the present invention to provide an improved lifting device, obviating the aforestated drawbacks.

In particular, it is object of the present invention to provide a lifting device of simple and compact construction which can be subjected to relatively high loads and is universally useable.

These objects and others which will become apparent hereinafter are attained in accordance with the present invention by providing an outer hollow section rail and an inner hollow section rail, both with closed cross section and essentially greater breadth than thickness, and by providing an electromotive operating drive with a linearly moveable output member which is operatively linked to either the outer section rail or the inner section rail.

The flat lifting device according to the invention requires essentially only the provision of the two hollow section rails in addition to the electromotive operating drive. These section rails are preferably made of light metal, e.g. aluminum, for weight reduction so that the overall lifting device can be produced in a cost-efficient manner.

The flat lifting device in accordance with the present invention can be mounted and assembled in any suitable position and thus is universally applicable. Moreover the lifting device can be best suited optically to e.g. the front of pieces of furniture since the visible outer surface can be coated accordingly or masked with a decorative sheet.

Since both section rails are relatively thin, there is only a very small demand for space so that the range for application of the lifting device is even further increased.

From a construction point of view, the linkage of the output element of the electromotive operating drive with either the inner or the outer section rail is advantageous because at least some components of the electromotive operating drive can be accommodated inside the inner section rail so that these components are protected.

Examples for hollow sections include rectangular sections which may however have various lateral edges. Since in some assemblies, the presence of sharp edges should be avoided, it is preferred to provide opposing longitudinal sides in form of an arc, preferably in form of a semicircle.

Moreover, according to another feature of the present invention, the outer contour of the inner section rail complements the inner contour of the outer section rail, or the outer contour of the inner section rail extends at small and constant distance from the inner contour of the outer section rail to form an annular gap therebetween.

The stability of the section rails can be increased in accordance with another feature of the present invention by providing the facing surfaces of the outer and inner section rails with interlocking profiles in moving direction of the extendible section rail. In this manner, also transverse forces can be increasingly received by the contacting surfaces of the profiles. These profiles can be made in a most simple manner by forming at least one broadside of the inner section rail with groove-like pockets which receive webs formed along the facing inner side of the outer section rail. Thus, the guidance of both section rails is additionally improved. Preferably, the cross section of the outer section rail and the cross section of the inner section rail are of rectangular configuration, with the width of the narrow sides being greater than the width of the broadsides. This reinforcement of the narrow sides results in a further increase of the stability of the section rails. Suitably, each narrow side is provided with at least one threaded bore which is open on one side and of circular cross section for allowing attachment of a connection piece or stop member to the inner and outer section rails. The corners of the section rails are rounded in form of a circular arc of relatively small radius to also avoid any sharp edges.

In order to reduce friction during travel of the respective section rail, the inside wall of the outer section rail has several grooves which extend in longitudinal direction for receiving guide rods, preferably of plastic material. These grooves and the guide rods are suitably disposed in opposing areas of the longitudinal sides, with the guide rods projecting beyond the inner surface of the outer section rail for contacting the inner section rail. Thus, these guide rods serve also as spacers. It is however also possible to arrange the grooves in the inner section rail for receiving the guide rods so as to follow the movement of the inner section rail. The guide rods then project beyond the outer surface of the inner section rail and contact the inner surface wall of the outer section rail.

The electromotive operating drive is generally provided with a rotatably powered adjusting spindle which, for protection purposes, is located within the inner section rail. At an upright position of the lifting device, the motor and possibly the gearing are situated in the lower area of the lifting device. Different assemblies may however require to link the drive motor or the drive gear motor of the electromotive operating drive via a flexible drive member with the rotatably powered adjusting spindle. Such a flexible drive member may be e.g. a conventional flexible shaft.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
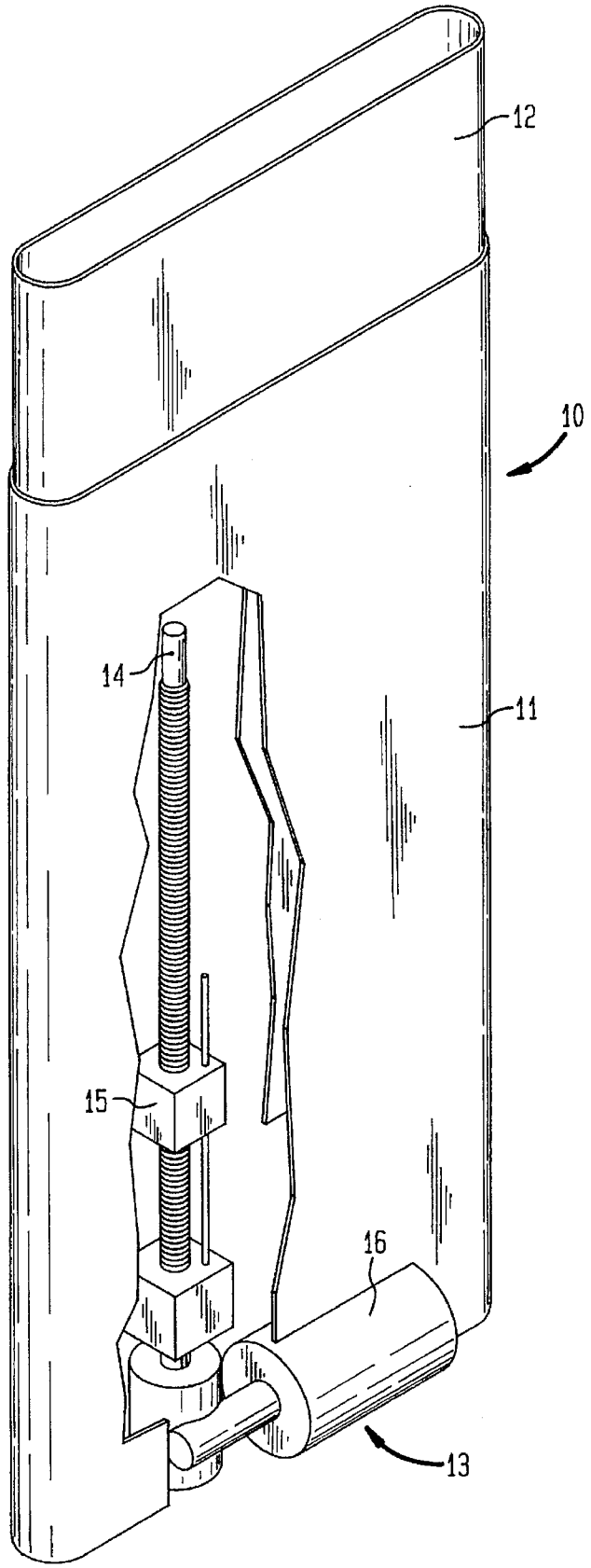
FIG. 1 is a perspective illustration of a first embodiment of a flat lifting device according to the present invention.

Throughout all the Figures, the same or corresponding lifting devices are always indicated by the same reference numerals.

Turning now to the drawing, and in particular to FIG. 1, there is shown a perspective illustration of a first embodiment of flat lifting device according to the present invention, generally designated by reference numeral 10. The lifting device 10 includes an outer hollow section rail 11, an inner hollow section rail 12 which is nested within the outer section rail 11, and an electromotive drive, generally designated by reference numeral 13. As shown by the broken-up area in FIG. 1, the drive 13 includes a gear motor 16 which is located at the lower end of the lifting device 10 and operatively connected to a vertical, rotatable threaded spindle 14 extending inside the inner section rail 12. Placed on the threaded spindle 14 is a block-shaped nut 15 which is securely attached to the inner section rail 12 in a manner not shown in detail. At operation of the gear motor 16, the threaded spindle 14 is rotated so as to respectively move the nut 15 in axial direction. Since being securely fixed to the nut 15, the inner section rail 12 follows the movement in vertical direction.

The outer section rail 11 and the inner section rail 12 are made of aluminum, with the outer section rail 11 completely surrounding the inner section rail 12, and with the section rails 11, 12 having corresponding or nearly corresponding lengths. Suitably, the section rails 11, 12 are respective tubes of circular cross section which are connected together by flat pieces. In the retracted position of the lifting device 10, the top faces of both section rails 11, 12, distant to the gear motor 16, are flush.

Figure 1A:
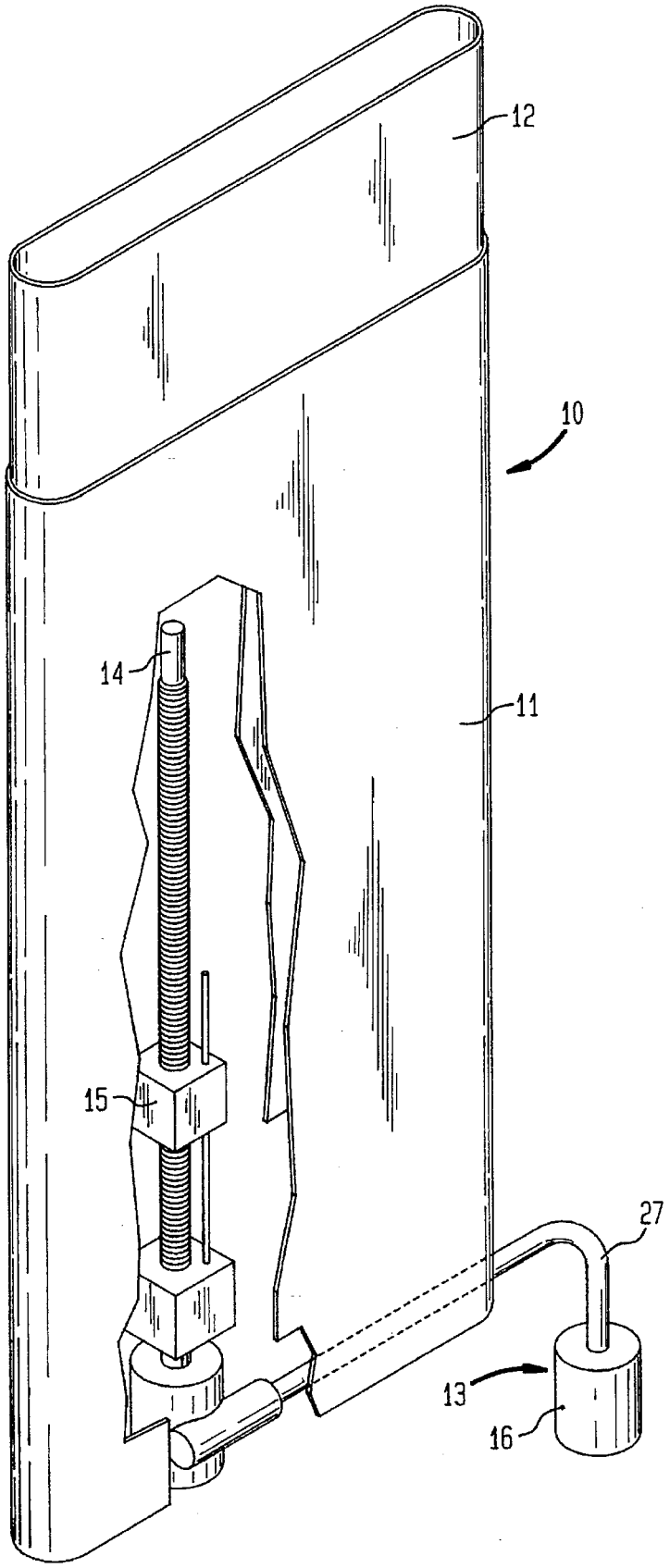
FIG. 1*a* is a perspective illustration of a variation of the lifting device of FIG. 1.

Even though FIG. 1 shows a direct connection between the spindle 14 and the gear motor 16, it will be understood by persons skilled in the art that it is possible to power the rotatable threaded spindle 14 also by means a flexible shaft 27, as shown in FIG. 1*a*, with the gearing being directly mounted to the electric drive motor, and with the flexible shaft 27 operatively connecting the gear motor 16 with the threaded spindle 14. This embodiment has the advantage that the flexible shaft 27 can be driven at relatively low speed. By utilizing the flexible shaft 27 as driving member between the electromotive drive and the gearing, the shaft 27 can be driven with the output speed of the motor.

Figure 2A:
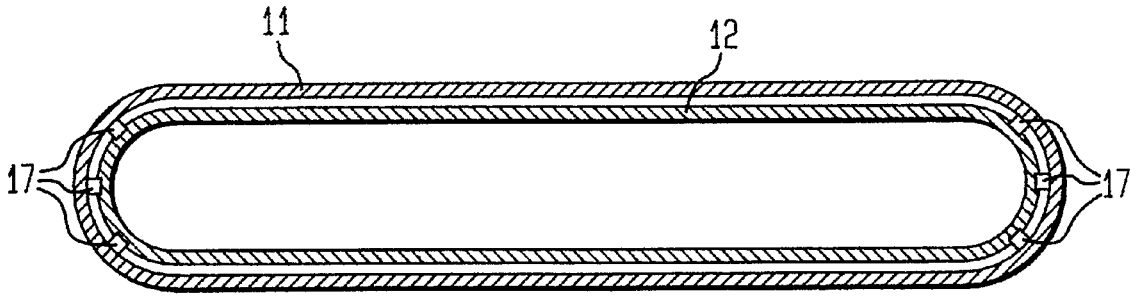
FIG. 2*a* is a cross sectional view of a variation of the lifting device of FIG. 1.
Figure 2:
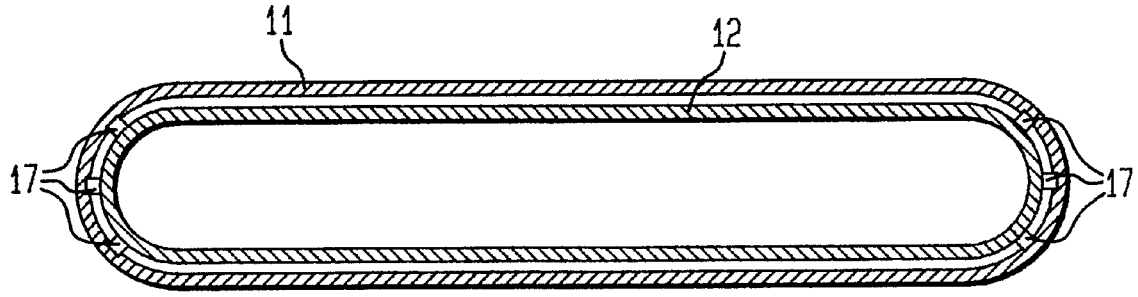
FIG. 2 is a cross sectional view of the lifting device of FIG. 1.

As best shown in FIG. 2, the opposing narrow sides of the section rails 11, 12 are of semicircular configuration to avoid sharp edges. Provided at the inside surface of the arched longitudinal sides of the outer section rail 11 are several (here three) grooves for receiving guide rods 17 of plastic material. The guide rods 17 project beyond the inner circumference of the outer section rail 11 and bear upon the outside of the inner section rail 12. In this manner, friction is reduced during relative movement between the section rails 11, 12 as the outer surface of the inner section rail 12 extends at a slight distance from the inner surface of the outer section rail 11.

Persons skilled in the art will understand that the grooves may also be provided at the outside of the inner section rail 12, with the guide rods 17 thus projecting beyond the inner section rail 12 for contacting the inner surface of the outer section rail 11, as shown in FIG. 2*a*. Also, the guide rods may be entirely omitted by completely or partially lining the outer surface of the inner section rail 12 or the inner surface of the outer section rail 11 with a friction-reducing coating, for example a slip sheet which is glued onto the respected surfaces.

Figure 3:
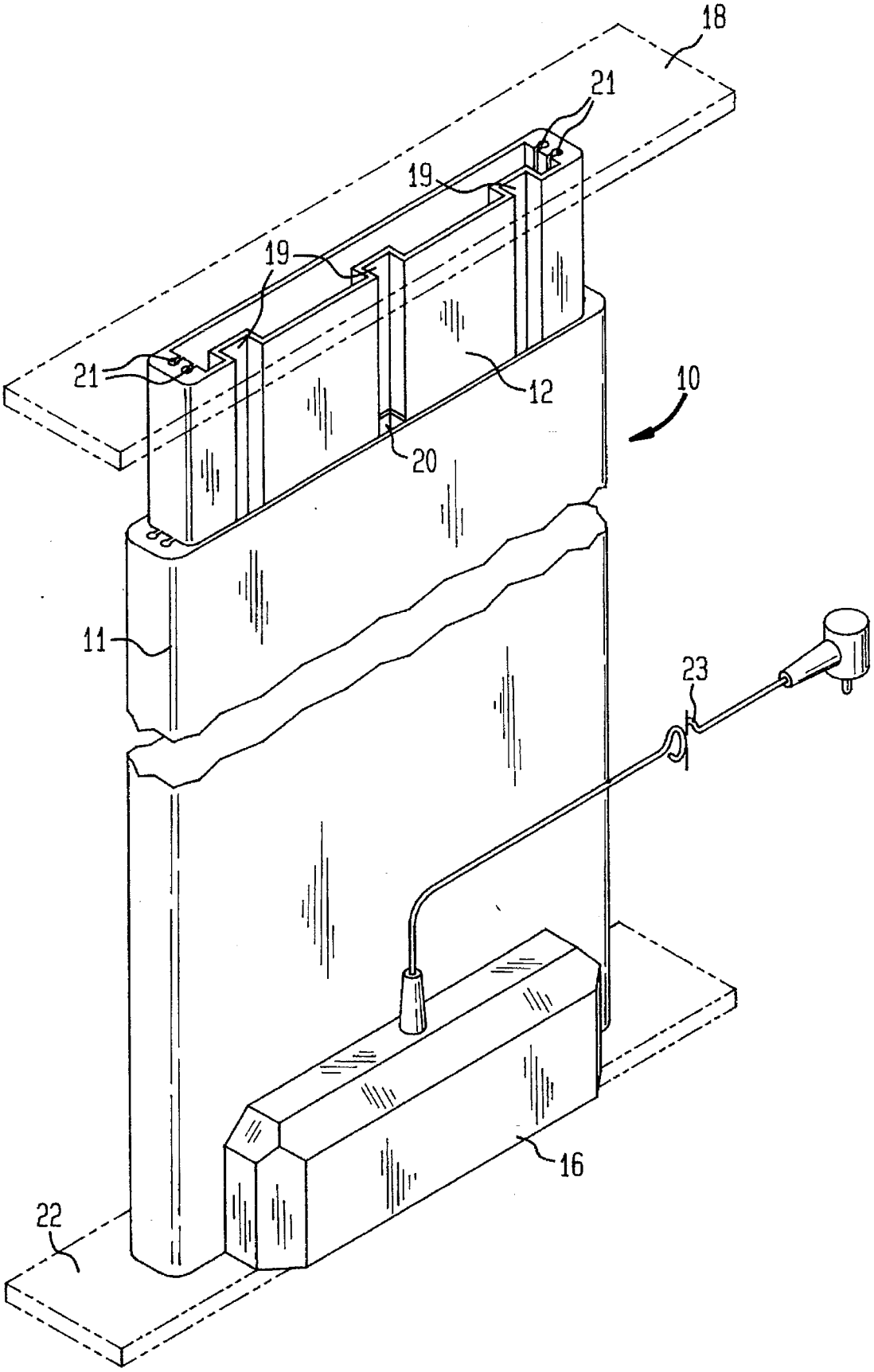
FIG. 3 is a perspective illustration of a second embodiment of a flat lifting device according to the present invention.

FIG. 3 shows a second embodiment of a flat lifting device 10 in which the section rails 11, 12 have complementary interlocking profiles in form of three pockets 19 arranged at one longitudinal side wall of the inner section rail 12 to create grooves for receiving webs or ribs 20 formed on the inside of the facing longitudinal side wall of the outer section rail 11. In this embodiment, the section rails 11, 12 are of rectangular cross section and have rounded corners to avoid sharp edges. Suitably, the section rails are made through extrusion.

As shown in FIG. 3, the narrow side walls of the section rails 11, 12 are reinforced, i.e. their thickness is greater than the thickness of the broad sides. Formed in the narrow side walls are threaded axial bores 21 to allow for example attachment of a connecting piece 18 to the sliding section rail 12 at the end face opposite to electromotive drive 13. The bores 21 of the opposing narrow side walls are of circular cross section and open at the facing inner sides.

As also shown in FIG. 3, the base of the lifting device 10 is also provided with suitable bores for attachment of another connecting piece 22. The gear motor 16 of the drive unit 13 is connected by a cable to a plug 23 for connection to a suitable power source.

By profiling the inner and outer section rails 11, 12 in a manner shown above, the stability is increased and transverse forces are better compensated. Also, the lifting device according to FIG. 3 can be provided with friction-reducing means, as described in connection with the embodiment shown in FIG. 1. It will also be appreciated by persons skilled in the art that the cross section of the section rails 11, 12 and the configuration of the drive unit are shown by way of example only.

Figure 4:
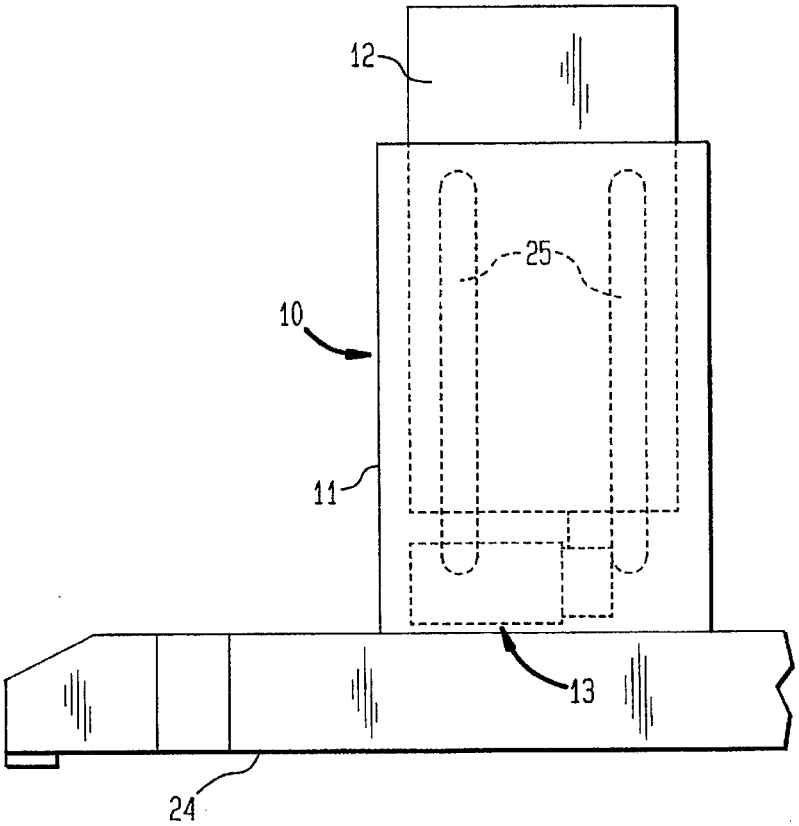
FIG. 4 is a plan view of a third embodiment of a flat lifting device according to the present invention.
Figure 5:
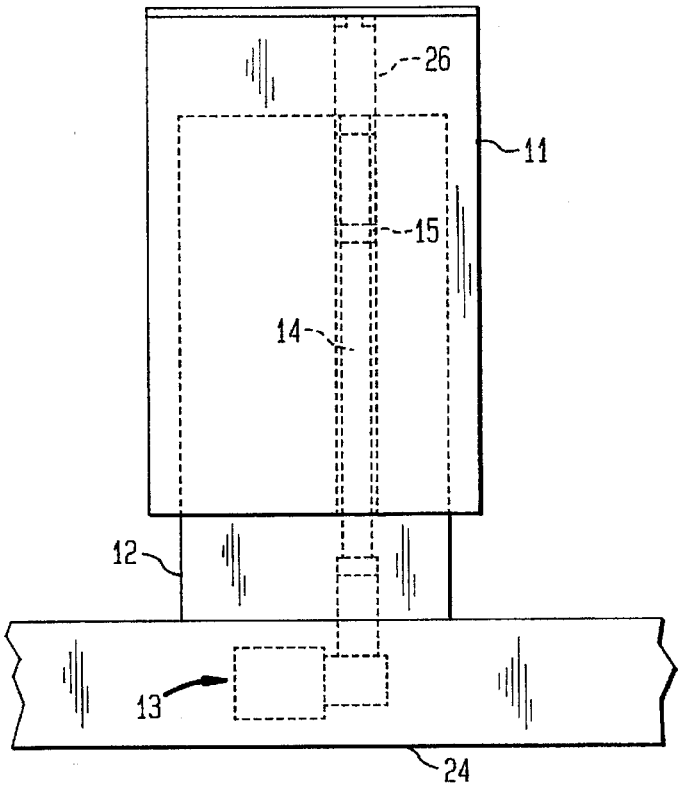
FIG. 5 is a plan view of a fourth embodiment of a flat lifting device according to the present invention.

FIGS. 4 and 5 show further embodiments of a flat lifting device 10 according to the present invention which is placed upon a rectangular beam 24 of a not shown piece of furniture. In FIG. 4, the electromotive drive 13 is accommodated within the outer section rail 11, while in FIG. 5 the electromotive drive 13 is accommodated within the beam 24.

In the embodiment of the lifting device according to FIG. 4, the inner section rail 12 travels relative to the outer section rail 11. For sake of simplicity, the threaded spindle 14 is not shown. At least one side wall of the outer section rail 11 is provided in longitudinal direction, i.e. in moving direction of the inner section rail 12, with oblong holes 25 to allow attachment of further components to the inner section rail 12. Thus, when the drive unit 13 slides the inner section rail 12 relative to the outer section rail 11, these further components will follow the movement of the inner section rail 12.

In the lifting device 10 according to FIG. 5, the outer section rail 11 is placed over the inner section rail 12. In order for the threaded spindle 14 to move the outer section rail 11, the inner section rail 12 is provided with a profile piece 26 in form of a square tube which extends axially through and is slightly shorter than the outer section rail 11, with its axial end face near the electromotive drive 13 being spaced from the respective end of the section rail 11. Extending within the profile piece 26 is the threaded spindle 14 with the block shaped nut 15 which is securely fixed to the profile piece 26.

Through rotation of the threaded spindle 14, the outer section rail 11 is displaced relative to the inner section rail 12 by the traveling nut 15.

In all embodiments of the lifting devices 10, the ratio between the breadth of the section rails 11, 12 to their thickness is about 5:1. Thus, the lifting device 10 is suitable for assembly in any position.

Persons skilled in the art will understand that the section rails 11, 12 according to FIGS. 1, 4 and 5 can certainly also be profiled in a same manner as the lifting device 10 according to FIG. 3.

Both end positions of the sliding section rails 11, 12 can be controlled by not shown limit switches which may be secured to a perforated rail to enable a simple repositioning when e.g. the maximum stroke of the slideable section rail 11 or 12 should not be fully utilized.

While the invention has been illustrated and described as embodied in a flat lifting device, it is not intended to be limited to the details shown since various modifications and structural changes may be made without departing in any way from the spirit of the present invention.

What is claimed as new and desired to be protected by Letters Patent is set forth in the appended claims:

1. A flat lifting device, in particular for pieces of furniture or the like; comprising:

an outer hollow section rail;

an inner hollow section rail accommodated within the outer section rail, said outer and inner section rails having a closed cross section and being defined by a thickness and a width, with the width being substantially greater than the thickness; and a drive unit having an linearly moving output member which is operatively connected to one of said section rails;

guide means in form of guide rods insertable in one of said section rails for effecting a spacing between said section rails and reducing friction during relative movement of said section rails, wherein said outer section rail has an inner surface area provided with axial grooves for securely receiving said guide rods which project beyond the inner surface area to bear upon said inner section rail.

2. The lifting device of claim 1 wherein said inner and outer section rails have opposing longitudinal sides in form of an arch.

3. The lifting device of claim 2 wherein said inner and outer section rails have opposing longitudinal sides in form of a semicircle.

4. The lifting device of claim 2 wherein said longitudinal sides are formed by tubes of circular cross section joined together by flat pieces.

5. The lifting device of claim 1 wherein the width and the thickness of said inner and outer rails have a ratio of about 5:1.

6. The lifting device of claim 1 wherein said guide rods are provided in opposing longitudinal sides of said inner and outer section rails.

7. The lifting device of claim 1 wherein said inner section rail is linked with said drive member of said drive unit, said outer section rail having at least one side provided with an oblong hole in moving direction of said inner section rail.

8. The lifting device of claim 1 wherein said drive unit includes a threaded spindle carrying said drive member which is operatively connected to said outer section rail, and a profile piece extending over said threaded spindle and securely fixed to said movable drive member.

9. The lifting device of claim 1 wherein said inner and outer section rails are made of a light metal and said guide rods are made of plastic material.

10. The lifting device of claim 9 wherein said inner and outer section rails are made of aluminum.

11. The lifting device of claim 1 wherein said drive unit includes a rotatably powered threaded spindle, said drive member being a nut mounted to one of said section rails.

12. The lifting device of claim 1 wherein said inner section rail has an outer surface lined with a friction-reducing coating.

13. The lifting device of claim 1 wherein said outer section rail has an inner surface lined with a friction-reducing coating.

14. The lifting device of claim 1 wherein said drive unit includes a motor, a threaded spindle, and a flexible transition member for operatively connecting said threaded spindle to said motor.

15. The lifting device of claim 14 wherein said flexible transition member is a flexible shaft.

16. A flat lifting device, in particular for pieces of furniture or the like; comprising:

an outer hollow section rail;

an inner hollow section rail accommodated within the outer section rail, said outer and inner section rails having a closed cross section and being defined by a thickness and a width, with the width being substantially greater than the thickness; and a drive unit having an linearly moving output member which is operatively connected to one of said section rails;

guide means in form of guide rods insertable in one of said section rails for effecting a spacing between said section rails and reducing friction during relative movement of said section rails, wherein said inner section rail has an outer surface area provided with axial grooves for securely receiving said guide rods which project beyond the outer surface area to bear upon said outer section rail.

17. The lifting device of claim 16 wherein said inner and outer section rails have opposing longitudinal sides in form of an arch.

18. The lifting device of claim 17 wherein said inner and outer section rails have opposing longitudinal sides in form of a sem.

19. The lifting device of claim 17 wherein said longitudinal sides are formed by tubes of circular cross section joined together by flat pieces.

20. The lifting device of claim 16 wherein the width and the thickness of said inner and outer rails have a ratio of about 5:1.

21. The lifting device of claim 16 wherein said guide rods are provided in opposing longitudinal sides of said inner and outer section rails.

22. The lifting device of claim 16 wherein said inner and outer section rails are made of a light metal and said guide rods are made of plastic material.

23. The lifting device of claim 22 wherein said inner and outer section rails are made of aluminum.

24. The lifting device of claim 16 wherein said drive unit includes a rotatably powered threaded spindle, said drive member being a nut mounted to one of said section rails.

25. The lifting device of claim 16 wherein said inner section rail has an outer surface lined with a friction-reducing coating.

26. The lifting device of claim 16 wherein said outer section rail has an inner surface lined with a friction-reducing coating.

27. The lifting device of claim 16 wherein said drive unit includes a motor, a threaded spindle, and a flexible transition member for operatively connecting said threaded spindle to said motor.

28. The lifting device of claim 27 wherein said flexible transition member is a flexible shaft.

29. The lifting device of claim 16 wherein said inner section rail is linked with said drive member of said drive unit, said outer section rail having at least one side provided with an oblong hole in moving direction of said inner section rail.

30. The lifting device of claim 16 wherein said drive unit includes a threaded spindle carrying said drive member which is operatively connected to said outer section rail, and a profile piece extending over said threaded spindle and securely fixed to said movable drive member.

* * * * *